US006568672B2

(12) United States Patent
Keller

(10) Patent No.: US 6,568,672 B2
(45) Date of Patent: May 27, 2003

(54) DEVICE FOR FORMING A STACK OF SUCCESSIVELY ARRANGED PRINTED SHEETS

(75) Inventor: Christof Keller, Zofingen (CH)

(73) Assignee: Grapha-Holding AG, Hergiswil (CH)

( * ) Notice: Subject to any disclaimer, the term of this patent is extended or adjusted under 35 U.S.C. 154(b) by 56 days.

(21) Appl. No.: 09/970,500

(22) Filed: Oct. 4, 2001

(65) Prior Publication Data

US 2002/0047236 A1 Apr. 25, 2002

(30) Foreign Application Priority Data

Oct. 20, 2000 (EP) ..... 00810974

(51) Int. Cl.[7] ..... B65H 29/38
(52) U.S. Cl. ..... 271/177; 271/181
(58) Field of Search ..... 271/177–181, 271/150, 31.1; 414/789.5, 789.9, 790.7; 53/542; B65H 29/14, 31/06, 31/30, 33/02, 29/16, 22/08, 13/20, 35/44

(56) References Cited

U.S. PATENT DOCUMENTS 4,034,845 A * 7/1977 Honegger ..... 198/418
4,172,531 A * 10/1979 Muller ..... 414/798.7
4,588,180 A * 5/1986 Ballestrazzi et al. ..... 271/5
4,641,489 A 2/1987 Wood ..... 53/529
4,934,687 A * 6/1990 Hayden et al. ..... 271/202
5,515,667 A * 5/1996 Roosli ..... 53/542

FOREIGN PATENT DOCUMENTS

| | | | |
|---|---|---|---|
| CH | 663397 | 12/1987 | |
| EP | 0340494 | 11/1989 | |
| EP | 0623542 | 11/1994 | |
| EP | 0 847 949 A1 * | 6/1998 | ..... B65H/33/02 |

* cited by examiner

*Primary Examiner*—Donald P. Walsh
*Assistant Examiner*—Kenneth W. Bower
(74) *Attorney, Agent, or Firm*—Friedrich Kueffner

(57) ABSTRACT

A device for forming a stack of successively arranged printed sheets has a stack support with support elements and a conveying device supplying printed sheets, arranged in an imbricated arrangement, in a vertical direction to the stack support. The printed sheets formed stacks on the stack support in a stack forming direction and the support elements define a leading end and a trailing end of the stacks. A controllable insertion device correlated with the stack support moves end plates into an intermediate position between the support elements and the leading and trailing ends of the stack, respectively. The insertion device has an insertion member arrangement with passages allowing the support elements to pass through and has a drive for moving the insertion member arrangement perpendicularly to the stack support for inserting the end plates. The insertion device has at least one interstice for receiving end plates.

11 Claims, 5 Drawing Sheets

DEVICE FOR FORMING A STACK OF SUCCESSIVELY ARRANGED PRINTED SHEETS

BACKGROUND OF THE INVENTION

1. Field of the Invention

The invention relates to a device for forming a stack of successively arranged printed sheets, comprised of a conveying device supplying the printed sheets in an imbricated arrangement vertically to a stack support and a controllable insertion device correlated with the stack support provided for stack formation and forming the length of the stack by end plates being moved at the stack ends into an intermediate insertion position between the support elements and the stack.

2. Description of the Related Art

Stacks which are formed in this way are referred to in technical jargon as "bundles" and the device for producing such bundles is referred to as a "bundler". The pressed and tied bundles are conventionally first stored intermediately and are then transported to a feeder that is provided for feeding the printed sheets to a processing line and that separates or individualizes the printed sheets.

A device of the aforementioned kind is disclosed in Swiss patent application 663 397. The end plates, which are inserted by hand primarily as a protection against damage of the printed sheet at the ends, require the presence of an operator 100% of the time; the operator, to a large degree, has to concentrate on a correct insertion of the end plates between the formed stacks and the support elements which support the stack at its ends. Monitoring of the paper flow in the supply area and the pressing process of the stack before delivery is limited to a large degree as a result of the time required for the manual insertion of the end plates; also, the readying of the end plates can hardly be accomplished by a single operator during operation of the device.

SUMMARY OF THE INVENTION

It is therefore an object of the present invention to provide an automation of the feeding action of the end plates to the ends of the stacks in order to make the work assignment easier for the operator and to provide sufficient time for monitoring of the collecting process that is under way as well as readying of the end plates.

In accordance with the present invention, this is achieved in that the insertion device is embodied so as to be correlated with the leading and trailing ends of the stack, provided with passages for the support elements which pass therethrough, drivable perpendicularly against the stack support, and configured to insert the end plates at the ends of the stack. This insertion device has at least one interstice that can receive an end plate. With such a device, the aforementioned disadvantages are substantially eliminated.

Preferably, the insertion device has at least two parallel securing plates receiving an end plate in the interstice.

The insertion device can have two interstices correlated with one end plate of a stack, respectively, so that fewer movements of the insertion device are required and more time is available for the insertion of the end plates.

It is advantageous when the insertion device can be loaded with the end plates in a receiving position which is displaced relative to the stack support at a right angle so that the readying of the end plates is simplified.

It appears to be expedient to load the insertion device with end plates in a retracted receiving position relative to the stack support so that an easily accessible storage or supply space is provided.

The adaptation of the end plate movement to the continuous stack formation process can be optimized when the insertion device is movable back and forth in the stack formation direction.

Preferably, the insertion device is arranged above the horizontally oriented stack support so that the end plates as a result of their own weight or by means of a transfer device can drop or can be moved into the insertion position.

Expediently, the securing plates are guided in a stationarily arranged stand parallel to the stack formation direction so that a simple drive can be used for generating the movements.

In order to be able to move the end plates on the shortest possible path into the operative intermediate position between the stack and the support elements, it is beneficial when at least one of the securing plates is provided with a retaining device which can be moved or switched into the interstice and is arranged above the passages, which are provided for the support elements to allow them to pass therethrough.

It has been proven to be expedient when the receiving position provided for loading the end plates is in the form of a magazine for stacking and dispensing end plates.

DESCRIPTION OF THE PREFERRED EMBODIMENTS

Figure 1:
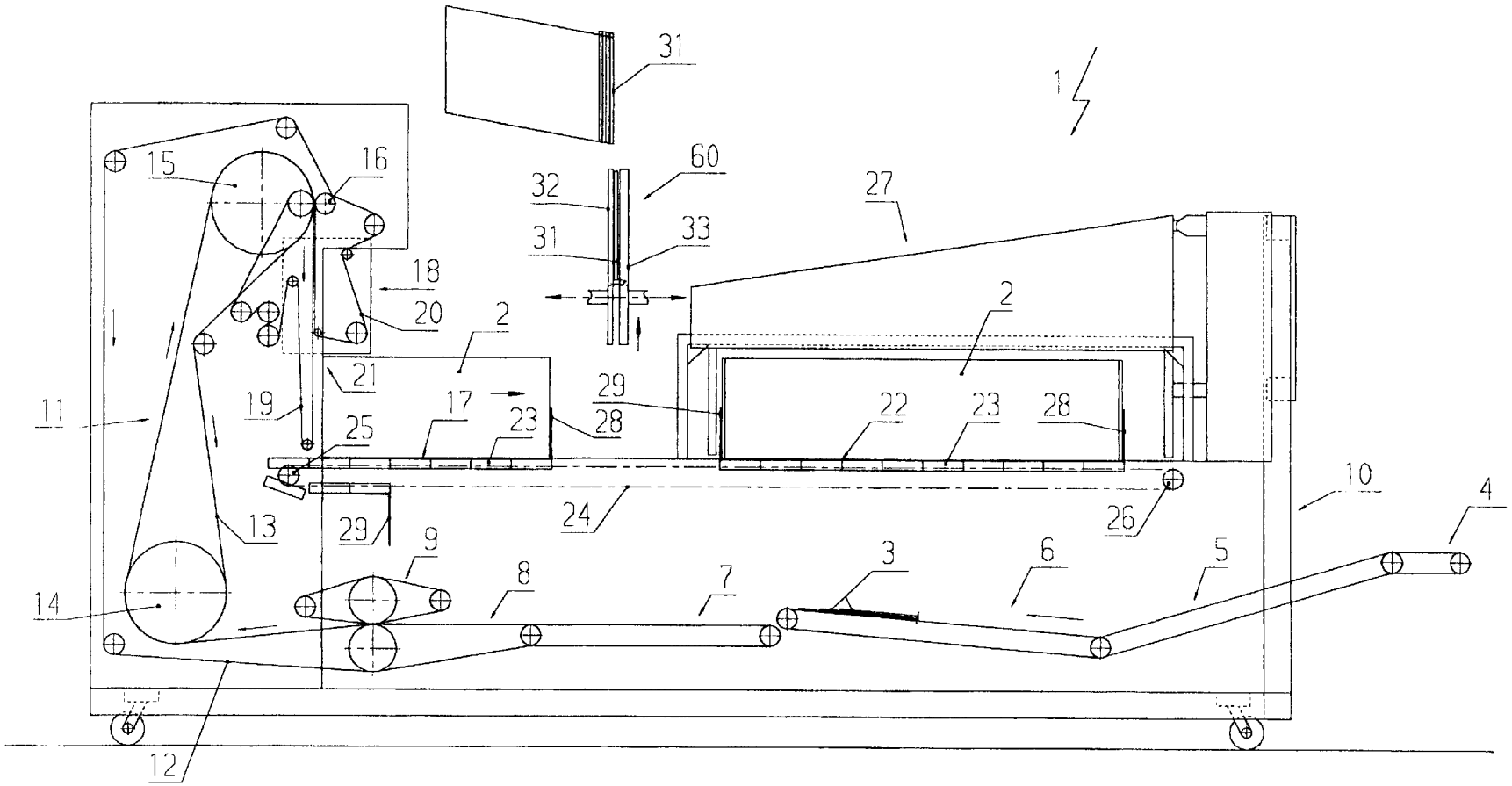
FIG. 1 is a schematic side view of the device according to the invention.

FIG. 1 shows a device 1, also referred to as "bundler", supported on a machine frame 10 and configured for forming a stack 2 of successively arranged printed sheets 3. The printed sheets 3 are supplied, with the folded edge leading, from the right side of FIG. 1 via conveyor belts 4 through 8 first through a pressing device 9, comprised of two stacked pressing rolls, for pressing the folds. The printed sheets 3 are transported in an imbricated arrangement in which the respectively trailing printed sheets 3 partially overlap the leading sheet (see imbricated arrangement on the conveyor belt 6). Such an imbricated arrangement can be received, for example, from a delivery device of a printing press. Downstream of the pressing device 9, the printed sheets 3 reach in the still overlapped or imbricated state a conveying section 11 which is positioned substantially vertically and is formed by conveyor belts 12, 13. Within the conveying section 11 the printed sheets 3 are clamped between the conveyor belts 12, 13 which circulate together about the pulleys 14, 15. The conveyor belt 12 runs downstream of the pulley 15 about the counter pulley 16 and across further rolls about the axis of the lower pressing roll of the pressing device 9 back to the pulley 14. The conveyor belt 13 is guided about the pulleys 14, 15 and, after leaving the pulley 15, is deflected away from the conveying path of the printed sheets 3. Such conveying devices are known, for example, from Swiss patent application 663 397, and the printed sheets 3 can be supplied overshot, as disclosed in European patent application 0 623 542. After a 180° deflection at the conveying end of the conveying section 11 the printed sheets 3 are transferred onto a conveying device 18 of the same type that is directed perpendicularly against a stack support 17. The conveying device 18 has conveyor belts 19, 20 with parallel runs which form a conveying channel 21 ending above the stack 2 that is forming and continued by the last printed sheet 3 placed on the stack support 17, 22. The function of the conveying channel 21 is also described in the above mentioned references.

The provided stack supports 17, 22 are fastened to two pulling members which are formed of two circulating chain pairs of which one is identified by 24. Each pulling member has correlated therewith a controllable drive motor (not shown) so that, for example, during the stack formation the stack supports 17, 22 can be moved at a reduced speed. The stack supports 17, 22 are formed of transversely extending, adjacently positioned strips 23 and are supported relative to the upper run of the pulling members on guide rails.

The pulling members extend about deflection rolls 25, 26 which, in the stack forming direction, are arranged upstream of the location where the imbricated arrangement reaches the stack supports and downstream of the stack pressing device 27. The stack supports 17, 22 have support elements 28, 29 arranged at the ends in pairs between which a stack 2 is formed and transported, respectively. At the beginning of the stack formation, the rearward support elements 29 of a stack support 17, 22 rest against the leading support elements 28 of a subsequently arranged stack support 17, 22 and thus form a stack separation when passing through the conveying channel 21. Along the further path, the completed stack 2, which has been separated from the trailing stack 2 by increasing its velocity, passes through a controllable insertion device 30 with which the end plates 31 are to be inserted between the support elements 28, 29 of the stack support 17, 22 and the stack 2 for protecting the edges of the stack 2 against damage. The insertion device 30 comprises two parallel securing plates 32, 33 as insertion members which are spaced apart from one another and thus form an interstice for at least one end plate 31. The securing plates 32, 33 have at their lower end slot-shaped passages or openings 38 through which the support elements 28, 29 can penetrate for compressing the stack of printed sheets 3.

In the following the end plate insertion during the stack formation process will be described in connection with FIGS. 2*a* to 2*f*. In FIG. 2*a* the stack 2 that is forming has reached a certain length and approaches with its leading end, which is formed by a support element pair 28, the insertion device 30 which has been supplied beforehand with an end plate 31 from a magazine 34 arranged above and is in an aligned position for inserting the end plate 31. As a result of the selected stack length or the stack speed, the insertion device 30, since the moment of receiving the end plate 31, has traveled a longer or shorter path until it has reached the illustrated position. Of course, to the detriment of the cycle time and, in any case, the quality, the insertion device 30 could be moved on shorter paths or operated during standstill, respectively, the end plates could be inserted during standstill. In the illustrated situation the insertion device 30 is in a position shortly before the end plates 31 are to be inserted between the leading end of the stack 2 and the support elements 28. For this purpose, the end plate 31 is retained at a level above the support elements 28 in the insertion device 30 for which purpose a retaining device 35 is provided. For a back and forth movement of the insertion device 30 in the horizontal direction or parallel to the stack formation direction, a guide arrangement 36 is provided which is illustrated in more detail in FIG. 3. The height adjustment of the securing plates 32, 33 is realized by a pneumatic actuating device 37 which is illustrated in FIG. 3. By means of the provided components it is possible to move the insertion device 30 on the economically shortest path for the transfer of the end plates 31 as well as for its return.

With an insertion device 30 that can receive two end plates 31 it would be possible to save one back and forth (reciprocating) movement to the stack support 17, 22, respectively, to the magazine 34. It would thus be possible to embody the insertion device 30 to have one interstice for one or two end plates 31 or to have separate interstices for two end plates 31.

Figure 2B:
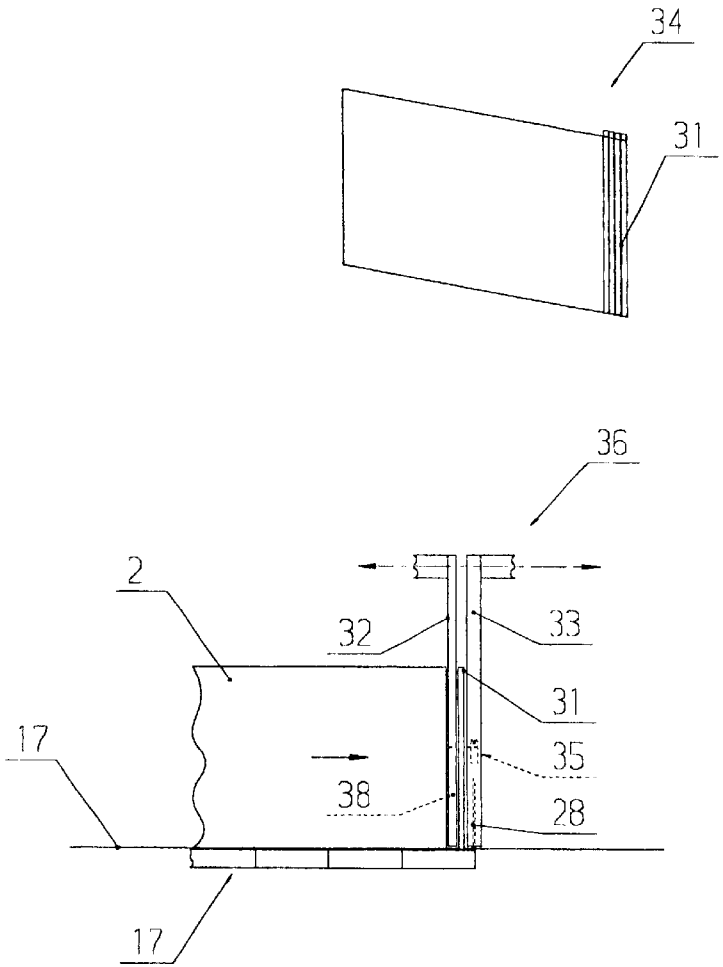
FIG. 2*b* is a schematic illustration of a second step of the end plate insertion during stack formation.
Figure 2A:
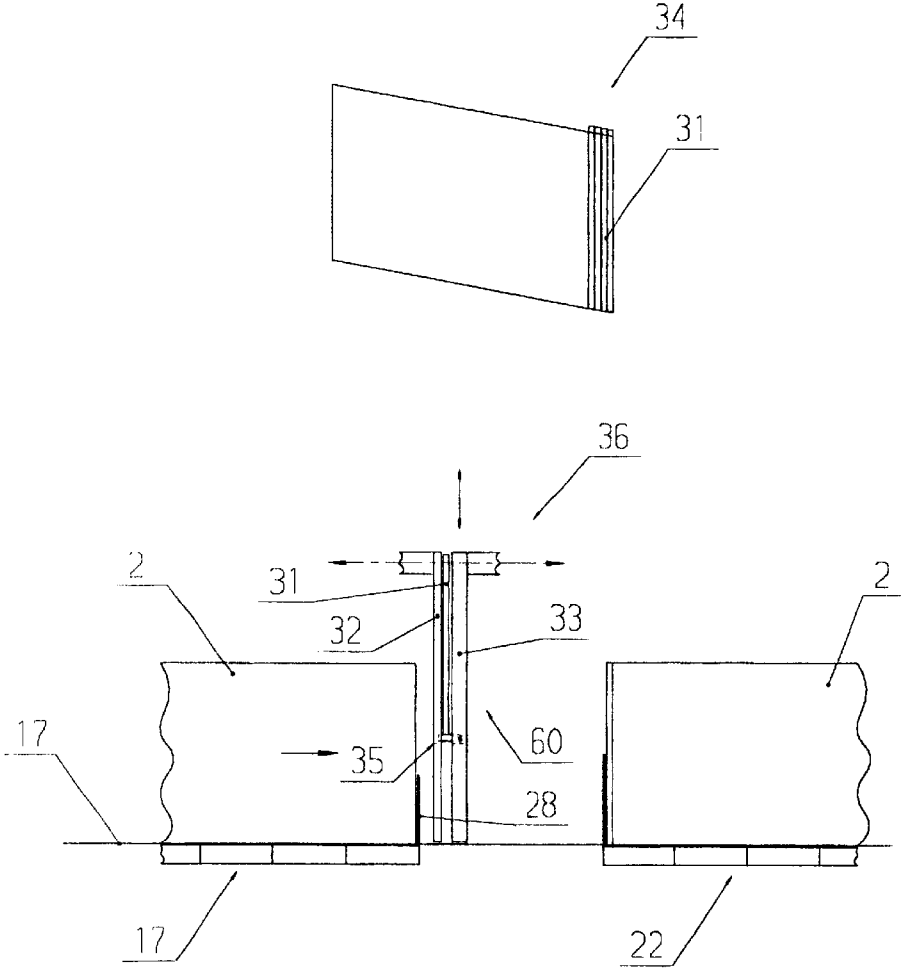
FIG. 2*a* is a schematic illustration of a first step of the end plate insertion during stack formation.
Figure 2D:
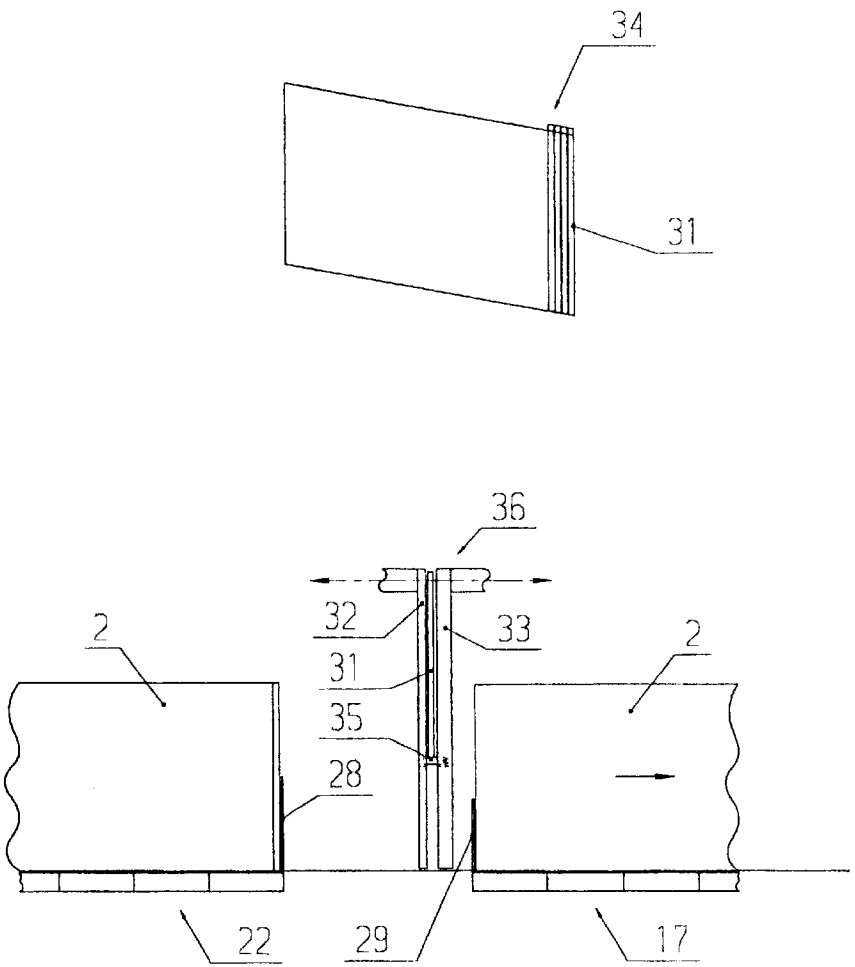
FIG. 2*d* is a schematic illustration of a fourth step of the end plate insertion during stack formation.
Figure 3:
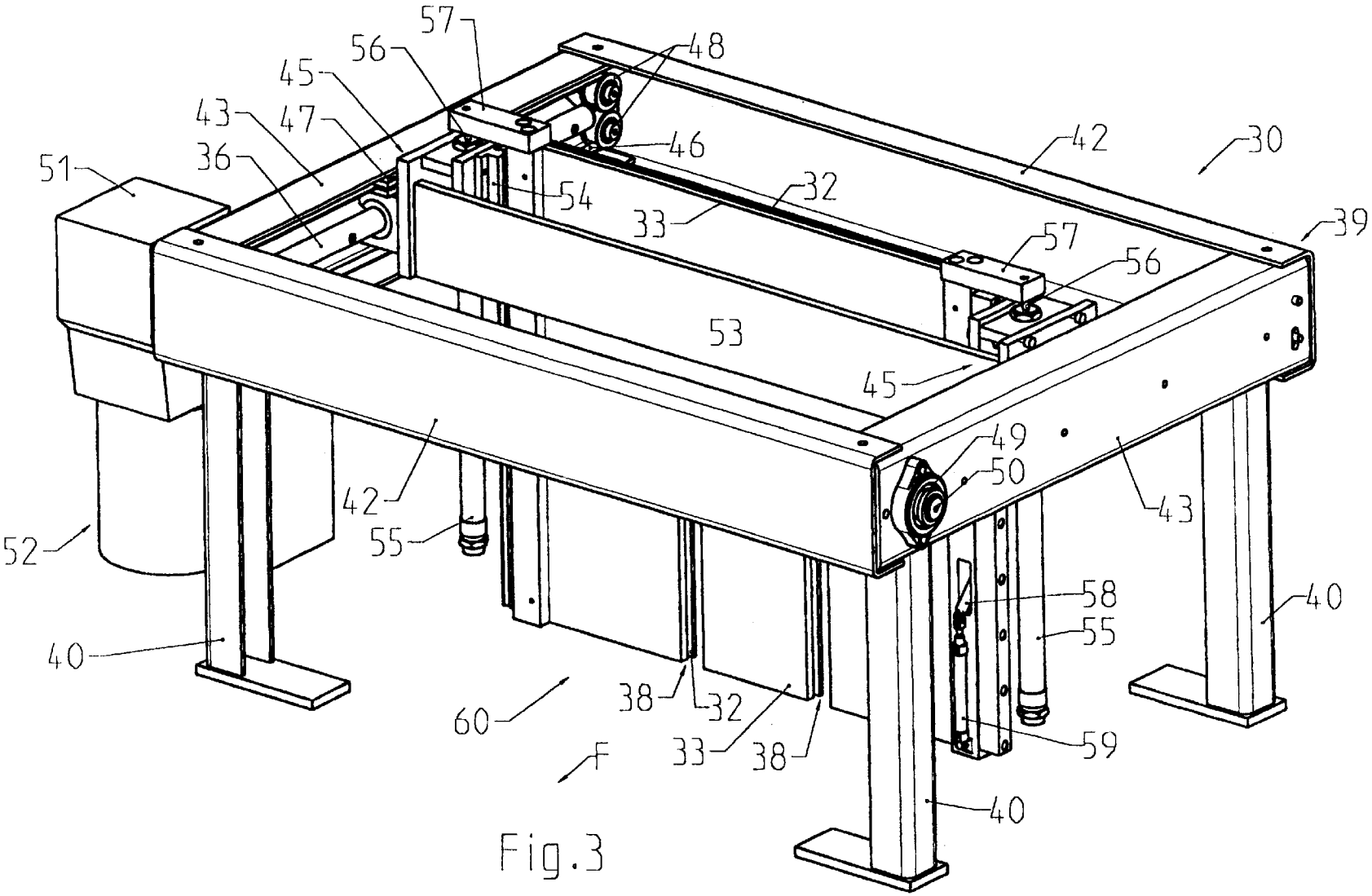
FIG. 3 is a perspective view of an insertion device for end plates.

In FIG. 2*b* the end plate 31 that has been loaded in the insertion device 30 has been lowered and has been moved into a position behind the support elements 28 as a result of the forward end of the stack 2 having been pushed back by the securing plate 32 of the insertion device 30, and in this position the end plate 31 is initially loosely seated in the interstice that is formed by the securing plates 32, 33.

Figure 2C:
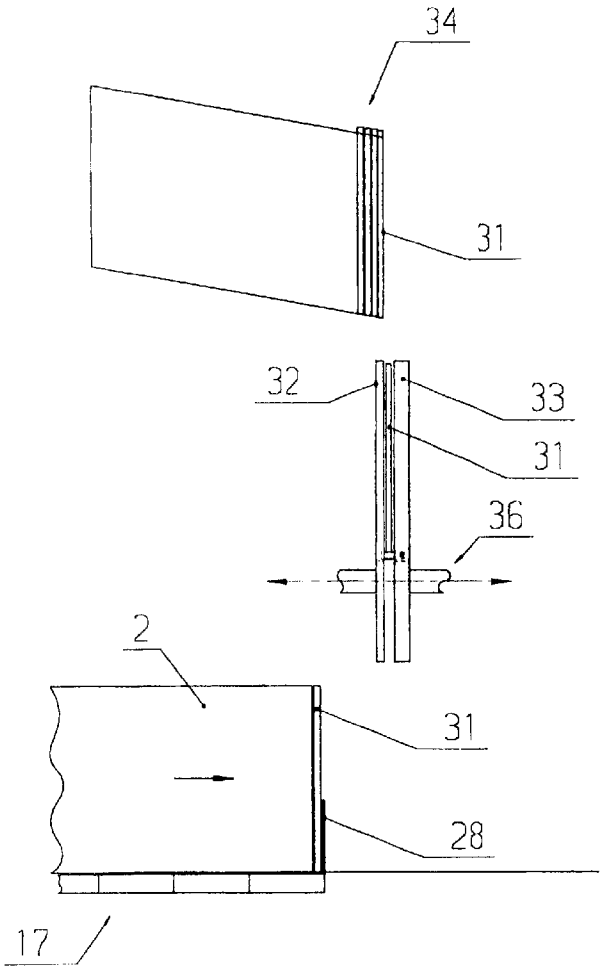
FIG. 2*c* is a schematic illustration of a third step of the end plate insertion during stack formation.

In FIG. 2*c* a further step is shown where the insertion device 30 has been lifted out of the stack 2 and the end plate 31, by expansion of the stack 2, is now clamped between the stack 2 and the support elements 28. The insertion device 30 has already received another end plate 31 which is provided for the trailing end of the stack 2. There is the possibility to provide the insertion device 30 with two interstices so that it can receive two end plates 31 and can place them successively at the ends of the stack 2, respectively. According to FIG. 2*d* the trailing end of the stack 2, which is determined by the support elements 29, has reached approximately the position for receiving the end plate 31; the insertion device 30 is also approximately in the aligned position.

Figure 2F:
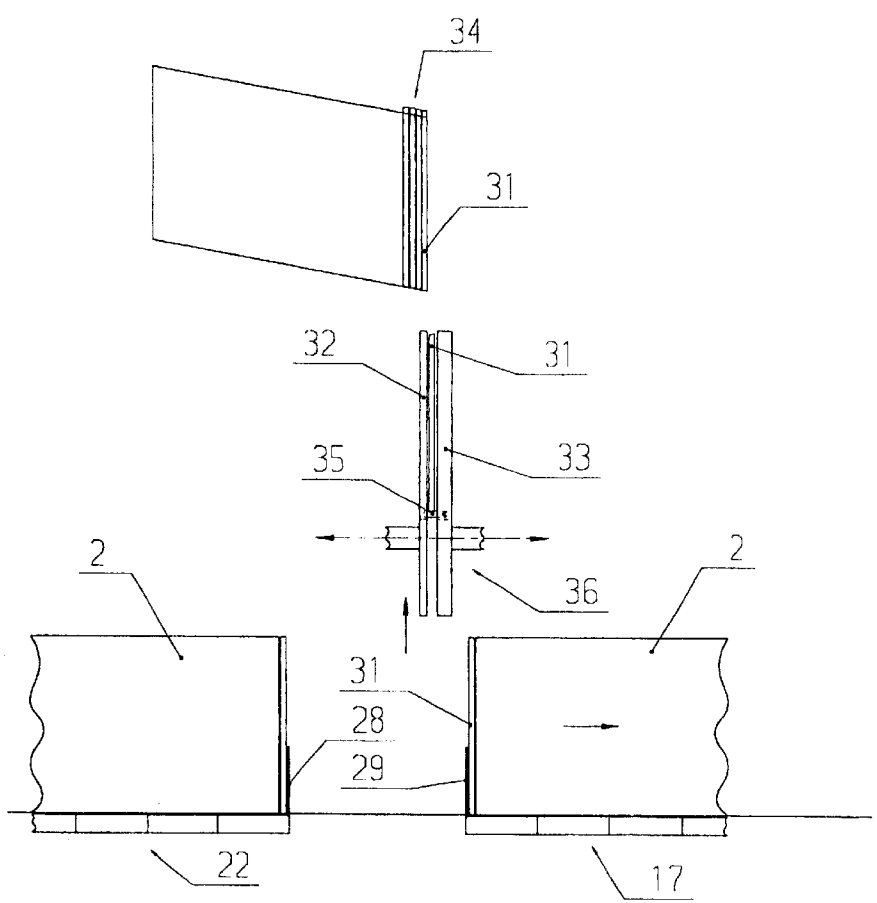
FIG. 2*f* is a schematic illustration of a sixth step of the end plate insertion during stack formation.
Figure 2E:
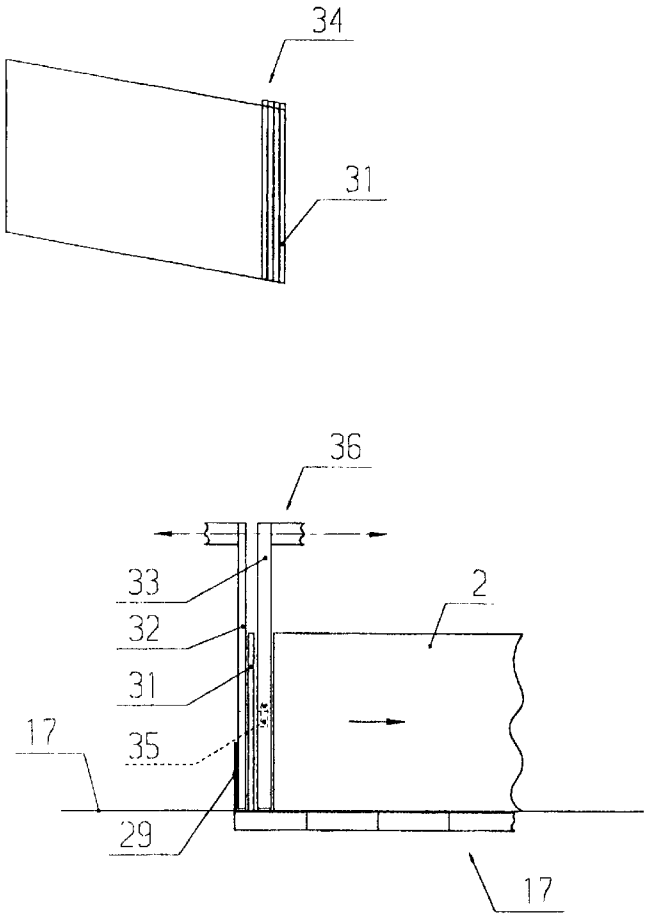
FIG. 2*e* is a schematic illustration of a fifth step of the end plate insertion during stack formation.

The insertion device 30 is now driven faster than the stack 2 in the stack forming direction so that instantly the position according to FIG. 2*e* is reached. In this position the trailing stack end is advanced such that between it and the trailing support elements 29 a gap results into which the end plate 31 can be inserted in the downward direction from above, i.e., from its retaining position in the insertion device 30. In FIG. 2*e* the retaining device 35 is already inoperative and the end plate 31 is resting on the stack support 17.

In FIG. 2*f* the insertion device 30 has been removed from the trailing stack end of the stack 2 and has already received an end plate 31 from the magazine 34 for the next stack 2 which follows at a certain spacing. In this connection, the retaining device 35 has been moved into the interstice between the securing plates 32, 33 and secures the end plate 31 in a lifted position above the openings or passages 38 so that the leading support elements 28 of the next stack 2 for insertion of the end plate 31 can pass through the securing plates 32, 33, as illustrated in FIGS. 2*a* and 2*b*.

In FIG. 3 an insertion device 30 with insertion member arrangement 60 with insertion members in the form of securing plates 32, 33 is shown in more detail than in FIGS.

1 and 2*a* through 2*e*. A stand 39 which is advantageously supportable and connectable with the machine frame 10 of the device is comprised of four support legs 40 having at their upper end a frame 41 comprised of two transverse beams 42 and two longitudinal beams 33. On the longitudinal beams 43 formed of a C-section member, the guide arrangement 36 is fastened on which the securing plates 32, 33 are guided or suspended in a drivable manner.

The guide arrangement 36 has a rod 44 extending parallel to the conveying direction (stack forming direction) F on which a support 45 is longitudinally slidably supported, respectively, which bears the securing plates 32, 33 of the insertion device 30. The support 45 is coupled respectively by a connecting member 47, for example, a clamping device with a drive belt 46 which is guided on one side of the frame 41 on deflecting rolls 48 arranged in pairs above one another and, on the opposite side, on a drive roll (only the bearing 49 is visible). The drive rolls are connected to a shaft 50 which is coupled with the gear mechanism 51 of the drive unit 52. The supports 45 are supported relative to one another by transverse strips 53 to prevent lateral tilting. The connected securing plates 32, 33 form an interstice for the end plate 31 and have passages 38 for the support element pairs 28, 29 provided at the ends of the stack supports 17, 22.

The securing plates 32, 33 are guided at the lateral ends on a guide 54 connected to the support 45, respectively, so as to be moveable in a vertical direction, wherein the upper position is correlated with receiving an end plate 31 from the magazine 34 (receiving position of the device 30), while in the lower position the securing plates 32, 33 are positioned for inserting the end plate 31 at the stack ends. The actuation of the securing plates 32, 33 is achieved by pneumatic cylinders 55 arranged at both sides which are fastened on the supports 45 and act by means of a piston rod 56 on a holder 57 fastened on the securing plates 32, 33.

The retaining device 35 is provided on the securing plate 33 and has a pawl 58 which is pivotable by means of a piston-cylinder unit 59 in the interstice and is thus movable into an operative position for retaining the end plates 31 and into an inoperative position for releasing the end plates 31.

While specific embodiments of the invention have been shown and described in detail to illustrate the inventive principles, it will be understood that the invention may be embodied otherwise without departing from such principles.

What is claimed is:

1. A device for forming a stack of successively arranged printed sheets, the device comprising:

a stack support having support elements;

a conveying device configured to supply printed sheets, arranged in an imbricated arrangement, in a vertical direction to the stack support, wherein the printed sheets are formed to stacks on the stack support in a stack forming direction and the supporting elements define a leading end and a trailing end of the stacks;

a controllable insertion device correlated with the stack support and configured to move end plates configured to form a length of a stack into an intermediate insertion position between the support elements and the leading and trailing ends of the stack, respectively;

wherein the insertion device comprises an insertion member arrangement having passages configured to allow the support elements to pass through;

wherein the insertion device comprises a drive configured to move the insertion member arrangement perpendicularly to the stack support for inserting the end plates;

wherein the insertion device comprises at least one interstice configured to receive at least one end plate.

2. The device according to claim 1, wherein the insertion member arrangement comprises at least two securing plates extending parallel to one another, wherein a first one and a second one of the securing plates define a first one of the interstices.

3. The device according to claim 2, wherein the insertion device comprises a third one and a fourth one of the securing plates, wherein the third and fourth securing plates define a second one of the interstices.

4. The device according to claim 3, wherein the first interstice is correlated with the leading end of the stack and the second interstice is correlated with the trailing end of the stack.

5. The device according to claim 2, wherein the securing plates are arranged above the stack support, wherein the stack support is horizontally arranged.

6. The device according to claim 5, wherein the insertion device comprises a stationary stand and wherein the securing plates are guided in the stationary stand.

7. The device according to claim 1, wherein the insertion device has at least one retaining device arranged above the passages and configured to be moved into the at least one interstice.

8. The device according to claim 7, wherein the retaining device is configured to secure the end plates in the at least one interstice and to release the end plates into the position between the support elements and the leading and trailing ends of the stack.

9. The device according to claim 1, wherein the insertion device is configured to receive the end plates in a receiving position that is displaced or retracted relative to the stack support.

10. The device according to claim 9, comprising a magazine for stacking the end plates wherein the magazine is configured to transfer the end plates to the insertion device when the insertion device is in the receiving position.

11. The device according to claim 1, wherein the insertion member arrangement is moveable parallel to the stack forming direction.

* * * * *